United States Patent [19]

Becker et al.

[11] Patent Number: 4,526,495

[45] Date of Patent: Jul. 2, 1985

[54] MINE ROOF SUPPORT ASSEMBLY

[75] Inventors: Kunibert Becker, Werl; Burckhardt Elsner, Lünen; Rüdiger Kirchbrücher, Dortmund-Brackel, all of Fed. Rep. of Germany

[73] Assignee: Gewerkschaft Eisenhutte Westfalia, Lünen, Fed. Rep. of Germany

[21] Appl. No.: 540,019

[22] Filed: Oct. 7, 1983

[30] Foreign Application Priority Data

Oct. 15, 1982 [DE] Fed. Rep. of Germany ..... 3238256

[51] Int. Cl.[3] ..... E21C 29/00; E21D 15/52; E21D 23/04

[52] U.S. Cl. ..... 405/299; 405/297; 299/31

[58] Field of Search ..... 405/291–293, 405/296–301; 299/31–33; 248/357; 91/170 MP; 105/161, 364; 173/23

[56] References Cited

U.S. PATENT DOCUMENTS

| | | | |
|---|---|---|---|
| Re. 28,556 | 9/1975 | Swoager | 405/299 |
| 3,879,088 | 4/1975 | Sodder, Jr. et al. | 405/298 X |
| 4,002,037 | 1/1977 | Hujimori et al. | 405/299 |
| 4,131,317 | 12/1978 | Jamison et al. | 299/33 X |
| 4,217,067 | 8/1980 | Lagodka et al. | 299/33 X |
| 4,330,226 | 5/1982 | Welzel et al. | 405/291 |
| 4,380,410 | 4/1983 | Büll et al. | 405/297 X |
| 4,402,634 | 9/1983 | Merten et al. | 405/299 |

FOREIGN PATENT DOCUMENTS

| | | | |
|---|---|---|---|
| 1099969 | 2/1961 | Fed. Rep. of Germany | 405/297 |
| 666567 | 2/1952 | United Kingdom | 405/298 |
| 2054715 | 2/1981 | United Kingdom | 405/297 |

*Primary Examiner*—Cornelius J. Husar
*Assistant Examiner*—Nancy J. Stodola
*Attorney, Agent, or Firm*—Maurice E. Gauthier

[57] ABSTRACT

A mobile mine roof support assembly has three mine roof support units coupled together by a common transverse beam. Roller devices are mounted beneath the floor sills of the support units. The roller devices are spring biased away from their floor sills so that they can lift the floor sills away from the floor of a working when the assembly is to be moved. At least one roller device of each support unit is a steerable roller device so that the assembly can be steered round bends. Each steerable roller device is pivotally mounted on its floor sill about a vertical axis, and is provided with an associated steering device. The steerable roller devices are preferably coupled together by means of a common steering device.

20 Claims, 5 Drawing Figures

MINE ROOF SUPPORT ASSEMBLY

BACKGROUND TO THE INVENTION

This invention relates to a mine roof support assembly constituted by at least two coupled mine roof support units, and in particular to an assembly which is movable for use in bord-and-pillar mine workings.

It is known to couple three mine roof support units side-by-side by means of a common transverse beam. In this case the advance mechanisms of the two outer support units are connected to the beam which is fixed to the middle support unit. (See DE-OS No. 2 655 076).

It is also known to arrange lateral support legs on the roof bars and the floor sills of roof support units in order to prevent the support units tilting as they are advanced. (See DE-PS No. 1099 969).

It is also known to provide mine roof support units with driven roler or caterpillar travelling mechanisms so that the support units can be moved easily. (See DE-OS No. 2 161 291).

The aim of the invention is to provide a mine roof support assembly having at least two coupled mine roof support units, the assembly being such that the roof support units can be advanced individually in accordance with the progress of winning or driving; and such that the entire assembly can be transferred quickly, and around bends, from one working point to another working point.

SUMMARY OF THE INVENTION

The present invention provides a mine roof support assembly comprising at least two coupled mine roof support units positioned side-by-side, each of the roof support units having a floor sill, and each of the floor sills being provided with floor-engageable roller means, wherein each of the roller means includes a steerable roller device, each steerable roller device being pivotally mounted on the associated floor sill about a pivot axis which lies at right-angles to the plane of that floor sill, and wherein each steerable roller device is provided with a steering device.

Not only are the support units of this assembly individually advanceable, but also the entire assembly can be transferred, by means of the floor-engageable roller means, rapidly from one working point to another working point. Since the roller means of each roof support unit includes at least one steerable roller device, as well as great mobility a good capacity for travel round bends is provided.

When the roof support units are anchored (set) by extending their props, their floor sills engage the floor of the working; while, in the transport and travel condition, the support units are supported on the floor by their roller means with the floor sills raised. The assembly may be provided with a propulsion device, such as a winch, for moving the assembly between different working points. Where the assembly is constituted by three roof support units, the propulsion device may be mounted on the middle roof support unit. Alternatively, the roller means may be provided with their own propulsion systems, for example hydraulic propulsion systems. For the independent supply of its different hydraulic consumer units, the support assembly expediently has its own pump assembly. The assembly can be supplied with electrical energy via a cable drawn behind the assembly.

Advantageously, each of the roller means comprises at least one steerable roller device and at least one non-steerable roller device. Preferably, each of the floor sills is constituted by a pair of floor girders, each of which is provided with a steerable roller device and a non-steerable roller device. In this case, each steerable roller device may be positioned at one end region of the associated floor sill, and each non-steerable roller device may be positioned at the other end region of that floor sill. In practice the steerable roller devices are positioned at the front ends of the floor sills.

In a preferred embodiment, each of the roller devices is mounted beneath its associated floor sill, and is spring biased away from said floor sill. The springs biassing the roller devices towards the floor of the working are rated so that they can lift the floor sills away from the floor when the hydraulic props of the associated unit are de-pressurised (robbed); but so that, when the props are pressurised, the floor sills are forced against the floor so that the roller devices are non-operative.

Advantageously, the roof support units are coupled to a common transverse beam. Where each of the roof support units is provided with an advance mechanism, the advance mechanisms may be attached to the transverse beam so as to couple the roof support units to the transverse beam.

In a preferred embodiment, the steerable roller devices are coupled together and are steerable by a common steering device. Separate steering devices for the individual support units of the support assembly are, therefore, not required. Advantageously, the steering device is constituted by a steering rail which is engageable with the steerable roller devices, and a hydraulic ram is provided for moving the steering rail transversely with respect to the floor sills. Preferably, the steering rail is mounted on the transverse beam for longitudinal movement relative thereto. Conveniently, the steering rail is slidably guided on a guide rail fixed to the upper side of the transverse beam, the hydraulic ram being arranged beneath the steering rail and within the transverse beam which is hollow.

Advantageously, each of the steerable roller devices is provided with a steering lever, the steering rail being engageable with the steering levers. Preferably, each of the steering levers is provided with an open-ended slot which is engageable with a respective projection provided on the steering rail.

Preferably, each of the roller devices is constituted by a pair of rollers mounted on a cross-member and rotatable about parallel axes, each of the rollers being of cylindrical form. This results in the weight of the support units being supported over the largest possible area. An endless track (or chain) may be guided round, and supported by, the rollers of each of the roller devices. Such tracks distribute the load upon the floor of the working over a large area.

The support units themselves can be of conventional formation, each having a goaf shield attached to a floor sill by a lemniscate linkage, and a roof bar having a forwardly-protruding extension. In order to move the support assembly, the support units can be attached together at their floor sills and/or at their roof bars or goaf shields by means of easily disengageable couplings, for example plug-in couplings, so that the support units form a substantially rigid assembly.

BRIEF DESCRIPTION OF THE DRAWINGS

A mine roof support assembly constructed in accordance with the invention will now be described, by way of example, with reference to the accompanying drawings, in which.

DESCRIPTION OF PREFERRED EMBODIMENT

Figure 1:
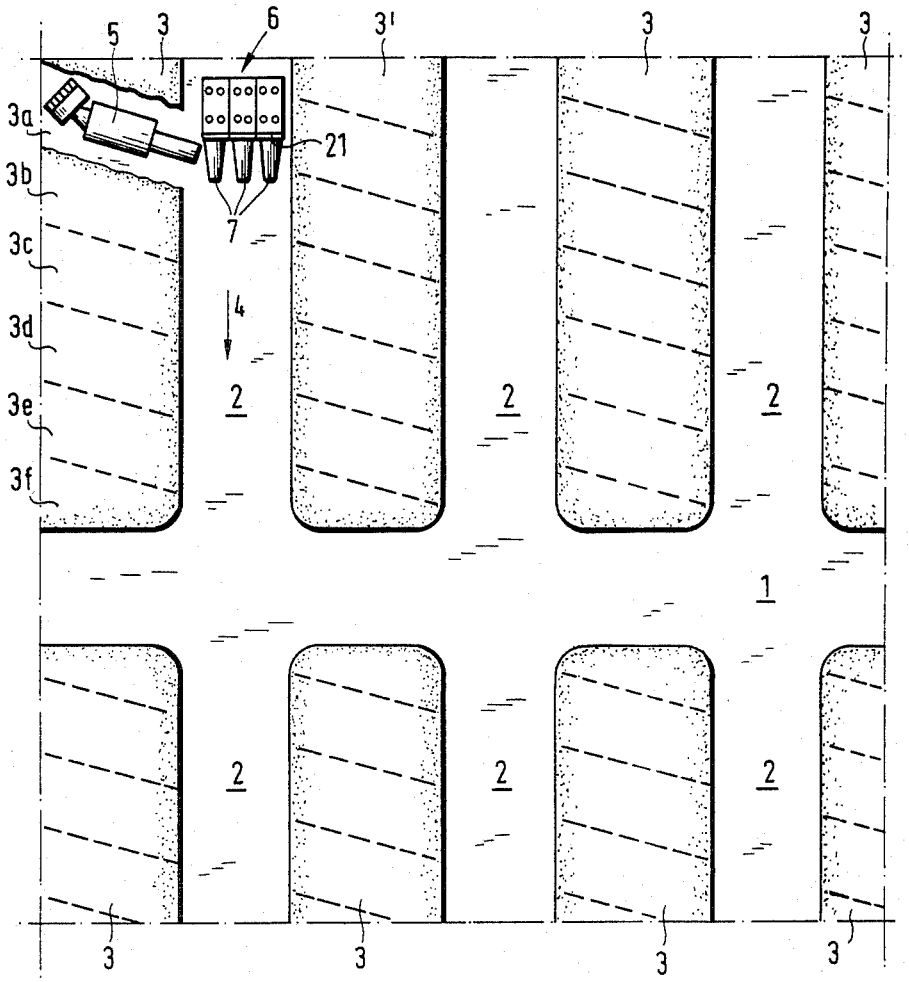
FIG. 1 is a diagrammatic plan view of a bord-and-pillar mine working, together with the mine roof support assembly.

Referring to the drawings, FIG. 1 shows a bord-and-pillar mine working having a roadway 1 which opens up into stalls 2 at right-angles thereto. The stalls 2 are driven into a coal (or other mineral material) seam at uniform intervals. The pillars 3 left standing between the stalls 2 are then worked, in sections, by return winning (that is to say towards the roadway 1 as indicated by the arrow 4). A winning machine 5, such as a so-called "Continuous Miner" is used for this return winning, the winning machine being controlled from the adjacent stall 2. The winning machine 5 can be provided with its own propulsion system, and may be provided with a trailing conveyor (not shown) which conveys the won material away to the roadway 1. As shown in FIG. 1, the pillars 3 are worked by transverse or oblique winning, that is in individual sections 3*a*, 3*b*. . . 3*f* (FIG. 1 showing the winning of the section 3*a*).

A mine roof support assembly 6 is provided in the stall 2 in the region adjacent to the section 3*a*, the support assembly being constituted by three roof support units each of which has a forward extension 7 on its roof bar. The forward extensions 7 are effective to support the roof of the working above the stall 2 in the region of the section 3*a* which is being won. The forward extensions 7 are preferably pivotally and/or slidably mounted on their roof bars, so that the operating crew of the winning machine 5 are protected by the forward extensions. Behind the support assembly 6, the roof of the working is allowed to cave in.

As soon as the section 3*a* of a given pillar 3 is won, the winning machine 5 is retracted underneath the support assembly 6. Then, as will be explained in greater detail below, the three support units of the support assembly 6 are advanced successively in the direction of the arrow 4 to advance the assembly into a position in which its forward extensions 7 are aligned with the next section 3*b* of the pillar 3. This next section 3*b* can then be won by the winning machine 5. This process is repeated until the entire pillar 3 has been won.

As soon as a given pillar 3 has been won in this way, the support assembly 6 is moved through the roadway 1 into the adjacent stall 2, whereupon the adjacent pillar (designated by the numeral 3′ in FIG. 1) is won in the same way. In this way, all the pillars 3 are won in succession by return winning, it being of course possible for several winning machines 5 to be in use in the different stalls 2 at the same time.

Figure 4:
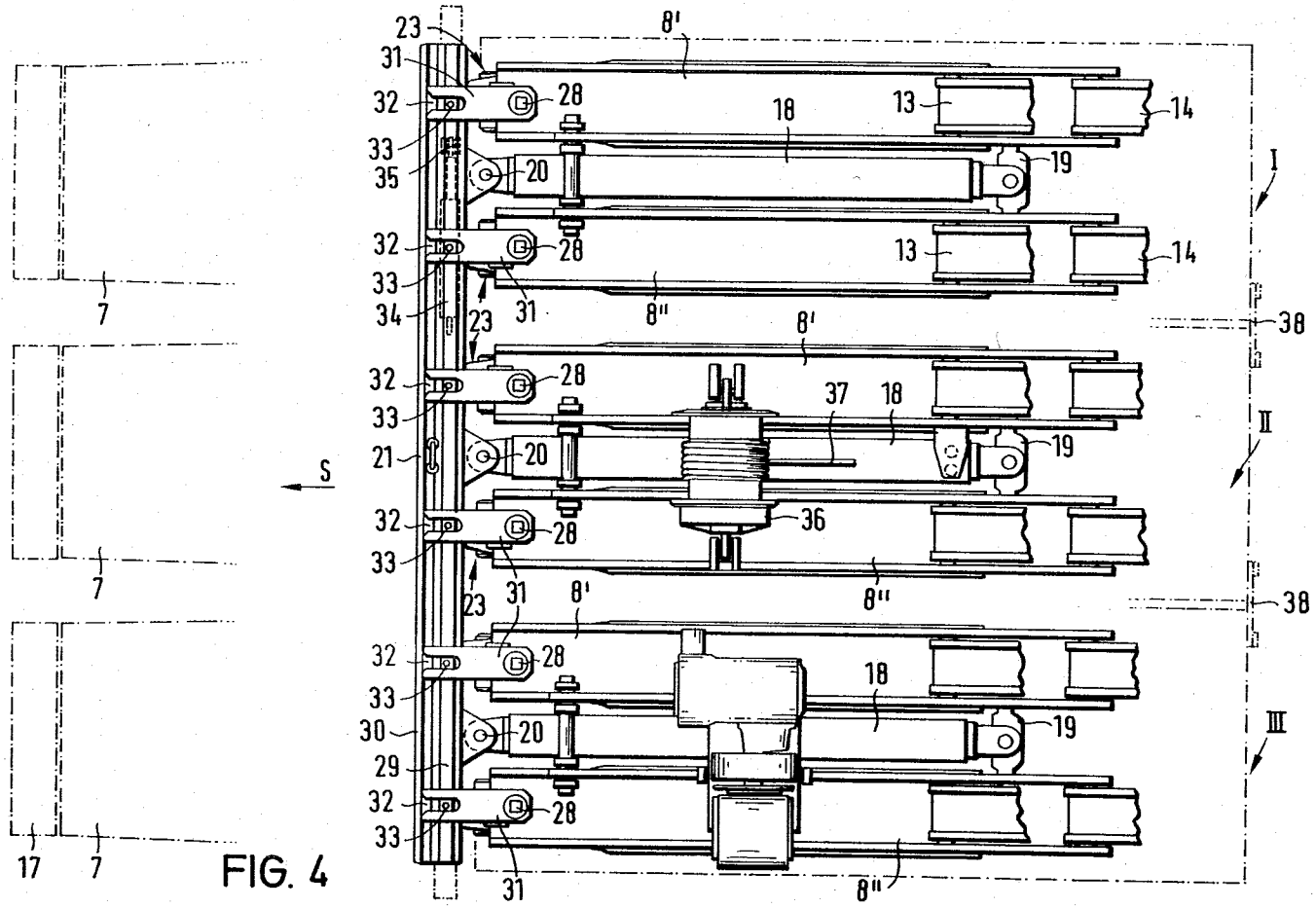
FIG. 4 is a plan view of the floor sills of the support assembly of FIGS. 1 to 3.

As shown in FIG. 4, the support assembly 6 is constituted by three substantially identical roof support units I, II and III, which are positioned side-by-side. Each roof support unit I, II or III has a floor sill 8, a roof bar 9, a goaf shield 10 and four hydraulic props 11 which are articulatedly interposed between the floor sill and the roof bar (see FIG. 2). The goaf shield 10 of each unit I, II or III is attached by a pivot joint 12 to the rear end of the roof bar 9, and is connected to the floor sill 8 by links 13 and 14. The links 13 and 14 form, with the goaf shield 10, what is called a lemniscate guide system. A forward extension 7 is provided at the front end of the roof bar 9 of each unit I, II or III. Each forward extension 7 is attached to its roof bar 9 by a pivot joint 15, so that it can be swung up to engage the roof of the working by means of a hydraulic ram 16. Each forward extension 7 is provided with a further extension bar 17 which is hydraulically-extensible and slidable within that forward extension. As shown in FIG. 4, each floor sill 8 is constituted by two parallel floor girders 8′ and 8″, each of which is connected to the goaf shield 10 by a respective pair of links 13 and 14.

A hydraulic advance ram 18 is positioned between the floor girders 8′ and 8″ of each unit I, II or III. The piston rod of each hydraulic advance ram 18 is articulatedly supported on a cross member 19 inter-connecting the associated two floor girders 8′ and 8″, the cylinders of the advance rams being articulatedly supported, via pivot joints 20, by a transverse beam 21 which lies in front of the three support units I, II and III. The beam 21 lies at right-angles to the advance direction S of the assembly 6, and extends substantially over the entire width of the assembly. The transverse beam 21 constitutes an abutment for the advance of the individual support units I, II and III. Thus, by extending all three rams 18, the transverse beam 21 can be advanced in the direction S. Then, the three support units I, II and III can be advanced in succession to follow up the advance of the beam 21. Each unit is advanced by retracting its props 11 and by retracting its ram 18, the transverse beam 21 acting as an abutment as it is held by the rams 18 of the other two support units which are fixed within the working owing to their props being extended.

Each roof support unit I, II and III is provided with its own roller travel mechanism, which is constituted by four roller support members 22 and 23. Two roller support members 22 of each mechanism are positioned at the rear end portions of the associated two floor girders 8′ and 8″, while the other two roller support members 23 are positioned at the front end portions of these two floor girders. Each roller support member 22 or 23 has a pair of rollers 25 rotatably mounted, about parallel horizontal axes, on a cross-member 24. The rollers 25 are cylindrical, and each is such that its axial dimension is greater than its diameter. The roller support members 22 and 23 are resiliently mounted on the floor girders 8′ and 8″ by means of springs 26. The springs 26 are supported by the floor girders 8′ and 8″, and press the roller support members 22 and 23 against the floor 27 of the working. The springs 26 are so rated that, when the hydraulic props 11 of a given unit I, II or III are depressurised (robbed), the floor girders 8′ and 8″ of that unit are lifted away from the floor 27 (see FIG. 2). When the hydraulic props 11 of a given unit I, II or III are pressurised, the springs 26 of that unit are compressed so that the associated floor girders 8′ and 8″ are forced against the floor 27.

The rear roller support members 22 are not pivotable about their vertical spindles 28 in relation to the associated floor girders 8′ and 8″, that is to say they are nonsteerably mounted on the floor girders. On the other hand, the front roller support members 23 are steerably mounted on the associated floor girders 8' and 8'', that is to say they are pivotally mounted on their floor girders about vertical rotation spindles 28. The steerable roller support members 23 of the three support units I, II and III are positively coupled together so as to be steerable by means of a common steering device. The steering device is constituted by a steering rail 29 which extends over substantially the entire length of the transverse beam 21. The rail 29 is guided on the upper side of the beam 21, in a rail guide 30, in such a manner as to be displaceable in the longitudinal direction of the beam. The steerable roller support members 23 are provided with steering levers 31 (see FIG. 4), which are fixed to the vertical pivot spindles 28 of the roller support members 23 for rotation therewith. The levers 31 have forwardly-open slots 32 at their front ends. These slots 32 can engage around vertical bolts (or journals) 33 which are fixed to the steering rail 29. A hydraulic steering ram 34 is positioned inside the transverse beam 21 beneath the steering rail 29, the cylinder of the steering ram being supported by the transverse beam, and the piston rod of the steering ram being connected to the steering rail by a joint 35, so that the steering rail can be displaced, in the longitudinal direction of the transverse beam, by a distance which corresponds to the working stroke of the steering ram (as indicated in dot-dash lines in FIG. 4). The ram 34 can be hydraulically locked to fix the steering rail 29 in any desired position, so that the steerable roller support members 23 can have a fixed, predetermined steering lock.

FIG. 4 shows the support assembly 6 in a position in which the transverse beam 21 lies directly in front of the floor sills 8 of the roof support units I, II, III. In this position, the bolts 33 engage within the slots 32, so that the steering levers 31 are coupled to the steering rail 29. The steering rail 29 can be shifted in either direction, in relation to the transverse beam 21, by retraction or extension of the steering ram 34. This movement of the steering rail 29 is transmitted, via the steering levers 31, to the steerable roller support members 23 to pivot these members about their vertical pivot spindles 28 in either direction.

Figure 2:
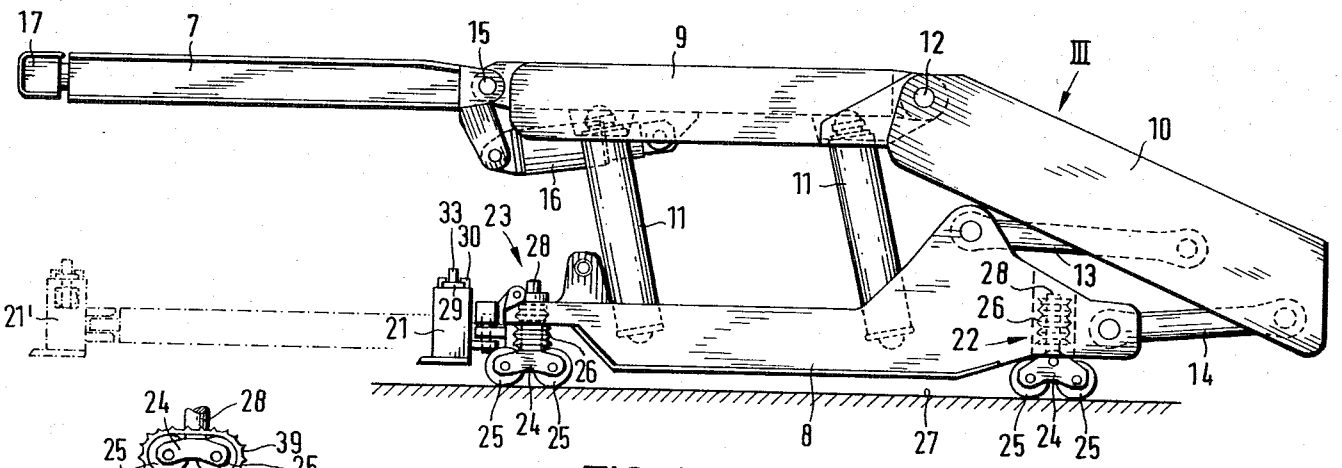
FIG. 2 is a side elevation of one roof support unit of the support assembly of FIG. 1.

When the transverse beam 21 is advanced relative to the roof support units I, II and III, the bolts 33 slide forwards out of the slots 32 of the steering rail 29, so that the support units can be advanced independently of one another by retracting their respective advance rams 18 The advanced position of the transverse beam 21 relative to the support units I, II and III is shown in dot-dash lines 21' in FIG. 2.

Figure 5:
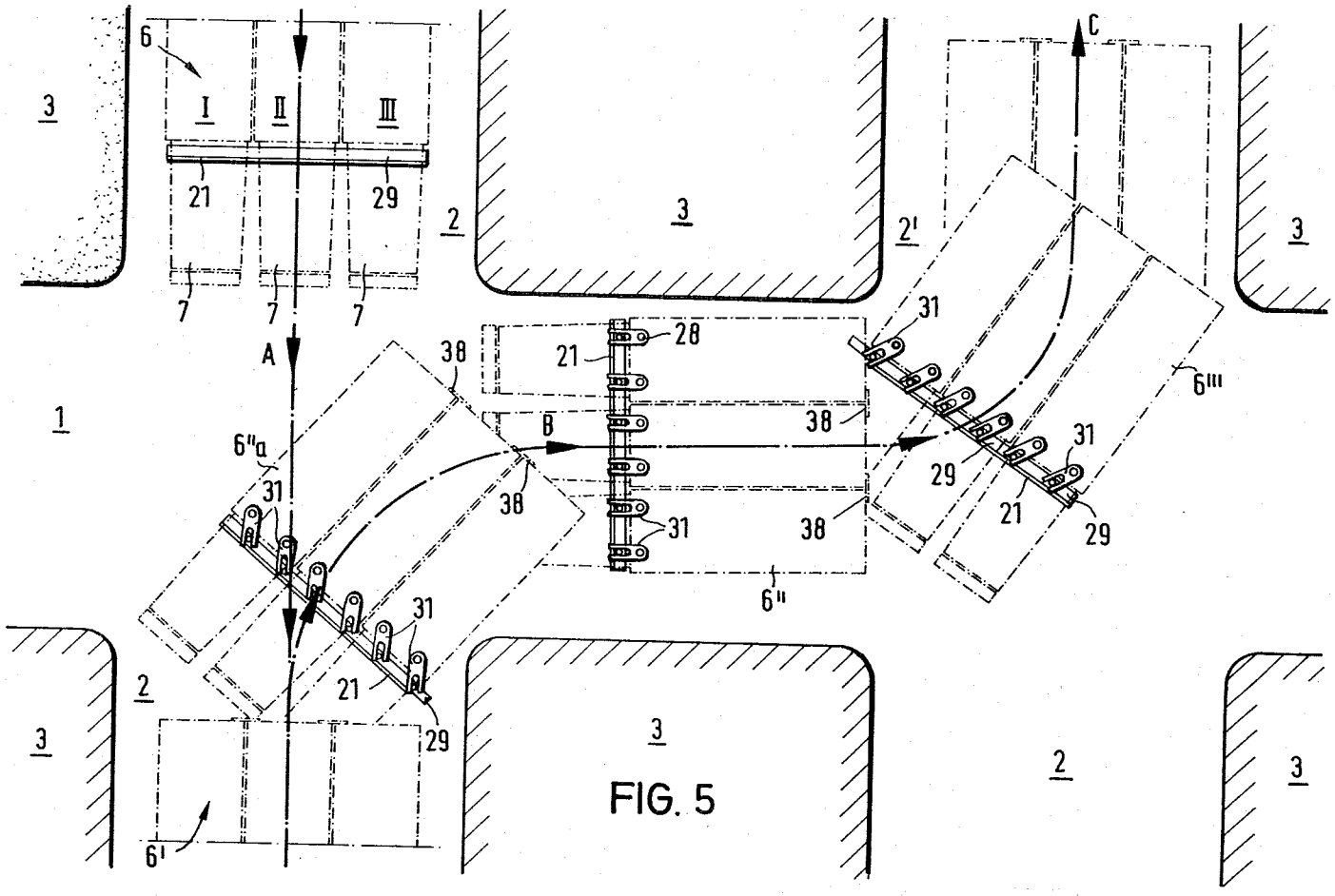
FIG. 5 is a schematic plan view of the working, and illustrates the movement of the support assembly from one working position to another working position.

Because the support units I, II and III can be moved when coupled together, the assembly 6 can be moved to follow the winning machine 5 as it wins a given pillar 3, as described above in connection with FIG. 1. In order to move the support assembly 6 into another stall 2 so as to win another pillar 3, the transverse beam 21 is retracted by the advance rams 18 to lie immediately in front of the support units I, II and III. As this happens, the bolts 33 slide into the slots 32 of the steering levers 31. The support assembly 6 can then be steered from the one stall 2 into the adjacent stall 2' (as shown in FIG. 5) Thus, after a given pillar 3 has been won, the support assembly 6 is driven, in the direction of the arrow A, transversely through the roadway 1 into the opposite stall 2 and into the position 6'. During this operation, the steering rail 29 is set, by the hydraulically-lockable steering ram 34, so that the steerable roller support members 23 have no steering lock to the left or to the right, that is to say they ensure straight-ahead travel in the direction of the arrow A. From the position 6', the support assembly 6 is then driven, in the direction of the arrow B back into the roadway 1 and into the position 6''. During this operation, it is necessary to travel round a bend of about 90°. In order to do this, the steerable roller support members 23 must be turned using the steering rail, 29. This is effected by appropriate retraction of the steering ram 34. The steering lock of the roller support members 23 during this reverse movement is indicated by the positions of the steering levers 31 shown in the intermediate position 6''a (see FIG. 5). In the position 6'', the steering ram 34 is extended, so that the roller support members 23 are turned in the opposite direction (as indicated by the positions of the steering levers 31 shown in the intermediate position 6''' in FIG. 5). With this steering lock, the support assembly 6 is driven, in the direction of the arrow C, into the adJacent stall 2', and here again a bend of about 90° has to be negotiated. Then, the support assembly 6 can be reversed to the end of the stall 2', during which the steerable roller support members 23 of course have no steering lock.

The support assembly 6 can be driven by a winch 36 and a cable 37. The winch 36 is arranged on the middle support unit II, and the cable 37 is attached to appropriate attachment points within the roadway 1 and the stalls 2. Alternatively, each of the roof support units I, II and III could be provided with its own propulsion unit for driving the rollers 25 of the roller support members 22 and 23.

During the transfer of the support assembly between adjacent stalls 2, it is advisable for the rear portions of the support units I, II and III to be connected together as well as their front portions. This can be effected, for example, by means of bolts or plug-in pegs 38 (see FIG. 5), which are arranged on the adjacent goaf shields 10. The three support units I, II and III, therefore, form a more or less rigid transport unit. It will be understood that, after the transfer of the support assembly 6, the locking pegs 38 must be released, so that the individual support units I, II and III can be advanced independently of one another. For travel round bends, it is advisable to arrange for the steerable roller support members 23 to be pivotable to both sides through an angle of about 45°. Thus, pivoting of the entire support assembly 6 is possible in the minimum space.

Figure 3:
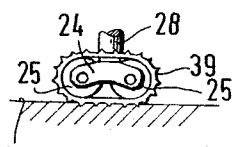
FIG. 3 shows a detail of FIG. 2.

As shown in FIG. 3, chains or caterpillar tracks 39 can be placed around the rollers 25 of the roller support members 22 and 23, so that the roller support members form small caterpillar track mechanisms.

We claim:

1. A mine roof support assembly comprising at least two mine roof support units positioned side-by-side and coupled to a common transverse beam, each of the roof support units having a floor sill, and each of the floor sills including floor-engageable roller means, wherein each of the roller means includes a steerable roller device, each steerable roller device being pivotally mounted on the associated floor sill about a pivot axis which lies at right-angles to the plane of that floor sill, and wherein the steerable roller devices are coupled together and are steerable by a common steering device which enables the support assembly to negotiate right-angled turns.

2. An assembly according to claim 1, wherein each of the roller means comprises at least one steerable roller device and at least one non-steerable roller device.

3. An assembly according to claim 2, wherein each of the floor sills comprises a pair of floor girders, each of which is provided with a steerable roller device and a non-steerable roller device.

4. An assembly according to claim 3, wherein each steerable roller device is positioned at one end region of the associated floor girder, and each nonsteerable roller device is positioned at the other end region of that floor girder.

5. An assembly according to claim 2, wherein each of the roller devices is mounted beneath its associated floor sill, and is spring biased away from said floor sill.

6. An assembly according to claim 1, wherein each of the roof support units includes an advance mechanism, the advance mechanisms being attached to the transverse beam so as to couple the roof support units to the transverse beam.

7. An assembly according to claim 1, wherein the steering device is a steering rail which is engageable with the steerable roller devices.

8. An assembly according to claim 7, further comprising a hydraulic ram for moving the steering rail transversely with respect to the floor sills.

9. An assembly according to claim 8, wherein the steering rail is mounted on the transverse beam for longitudinal movement relative thereto.

10. An assembly according to claim 9, wherein the steering rail is slidably guided on a guide rail fixed to the upper side of the transverse beam.

11. An assembly according to claim 10, wherein the hydraulic ram is arranged beneath the steering rail.

12. An assembly according to claim 11, wherein the transverse beam is hollow, and the hydraulic ram is positioned within the transverse beam.

13. An assembly according to claim 7, wherein each of the steerable roller devices includes a steering lever, the steering rail being engageable with the steering levers.

14. An assembly according to claim 13, wherein each of the steering levers is formed with an open-ended slot which is engageable with a respective projection provided on the steering rail.

15. An assembly according to claim 1, wherein each of the roller devices comprises a pair of rollers mounted on a cross-member and rotatable about parallel axes.

16. An assembly according to claim 15, wherein each of the rollers is of cylindrical form.

17. An assembly according to claim 15, wherein an endless track is guided round, and supported by, the rollers of each of the roller devices.

18. An assembly according to claim 1, further comprising a propulsion device for moving the assembly.

19. An assembly according to claim 18, wherein the propulsion device is a winch.

20. An assembly according to claim 1, wherein there are three roof support units.

* * * * *